United States Patent [19]

Hatori et al.

[11] 4,185,562

[45] Jan. 29, 1980

[54] SUSPENDED DRIVING RAILWAY CAR

[75] Inventors: Yukiyoshi Hatori; Shinji Katayose, both of Tokyo, Japan

[73] Assignee: Nissan Motor Company, Limited, Japan

[21] Appl. No.: 824,317

[22] Filed: Aug. 12, 1977

[30] Foreign Application Priority Data

Aug. 31, 1976 [JP] Japan ..... 51-103880

[51] Int. Cl.[2] ..... B61B 3/02; B61B 7/06; B61B 7/12; B61C 13/06

[52] U.S. Cl. ..... 105/152; 104/93; 104/110; 104/112; 105/149; 105/156

[58] Field of Search ..... 104/89, 93, 106, 110, 104/112; 105/148, 149, 150, 151, 152, 153, 154, 155, 156, 157

[56] References Cited

U.S. PATENT DOCUMENTS

| | | | |
|---|---|---|---|
| 708,175 | 9/1902 | Schmitz | 105/152 |
| 1,312,417 | 8/1919 | Mosher | 105/155 |
| 1,412,831 | 4/1922 | Bennington | 105/152 |
| 1,551,223 | 8/1925 | Smith | 104/112 |
| 3,525,306 | 8/1970 | Edel et al. | 105/150 |
| 3,543,687 | 12/1970 | Ellzey | 105/153 |
| 3,587,473 | 6/1971 | Weiss et al. | 104/93 |
| 3,625,158 | 12/1971 | Lorenz et al. | 104/93 |

FOREIGN PATENT DOCUMENTS

| | | | |
|---|---|---|---|
| 164681 | 10/1905 | Fed. Rep. of Germany | 105/154 |
| 550771 | 5/1932 | Fed. Rep. of Germany | 105/153 |
| 270877 | 5/1927 | United Kingdom | 105/153 |

*Primary Examiner*—Stephen G. Kunin
*Assistant Examiner*—Howard Beltran
*Attorney, Agent, or Firm*—Robert E. Burns; Emmanuel J. Lobato; Bruce L. Adams

[57] ABSTRACT

A vehicle suspended from a trackway of an aerial trackway system is provided. The vehicle comprises a front traction unit having a supporting wheel and a rear traction unit having a supporting wheel. These traction units support a vehicle body of the vehicle and are rotatable relative to the vehicle body such that the supporting wheels may follow the trackway without slip. Apparatus is provided for linking the front and rear traction units such that a moment at the center of gravity of the front traction unit about its axis of rotation relative to the vehicle body and a moment at the center of gravity of the rear traction unit about its center of rotation relative to the vehicle body are balanced.

10 Claims, 4 Drawing Figures

SUSPENDED DRIVING RAILWAY CAR

BACKGROUND OF THE INVENTION

The present invention relates to a vehicle, for use in an aerial trackway system, which comprises front and rear traction units to suspend a vehicle body from a trackway, each traction unit having a supporting wheel on the trackway, and means for improving running stability of the vehicle.

For use in an aerial trackway system, such as one using a rope or another using a rail, a vehicle is known which has front and rear traction units rotatably mounted on a vehicle body at forward and rearward parts of the vehicle body, respectively, so that supporting wheels of the traction units may follow a curve, with a small curvature, of the trackway. In the vehicle, owing to the fact that each of frames of the traction units is generally C-shaped so as to prevent the traction units from contact with the trackway, it is necessary to mount the traction units on the vehicle body with their centers of gravity disposed outside of a vertical plane including the center of the trackway and the center of gravity of the vehicle. This arrangement will cause the traction units to rotate, causing the wheels to wobble, thus degrading running stability of the vehicle. It is conceivable, to solve this shortcoming, to provide a counter weight to each traction unit to dispose its center of gravity adjacent a vertical plane including the center of the trackway and the center of gravity of the vehicle. However, this results in an increase of the weight of the vehicle and thus is disadvantageous.

SUMMARY OF THE INVENTION

It is therefore an object of the present invention to provide a vehicle for use in an aerial trackway system which has eliminated the shortcoming as above.

According to the present invention, a front traction unit and a rear traction unit are linked such that a moment at the center of gravity of the front traction unit about its axis of rotation and a moment at the center of gravity of the rear traction unit are balanced, in order to prevent wobbling of supporting wheels upon acceleration or deceleration of the vehicle.

IN THE ACCOMPANYING DRAWINGS

The invention will be described further with reference to the accompanying drawings, in which:-

DETAILED DESCRIPTION OF THE INVENTION

Figure 1:
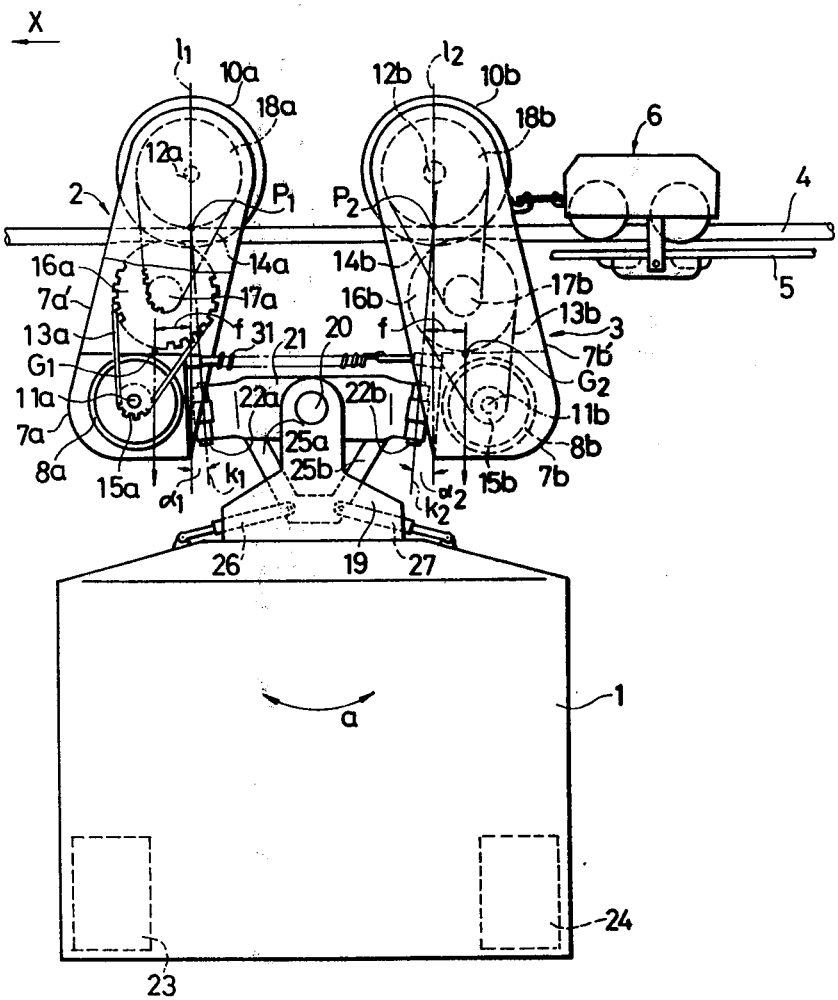
FIG. 1 is a side elevational view of a first embodiment of a vehicle constructed in accordance with the present invention.
Figure 2:
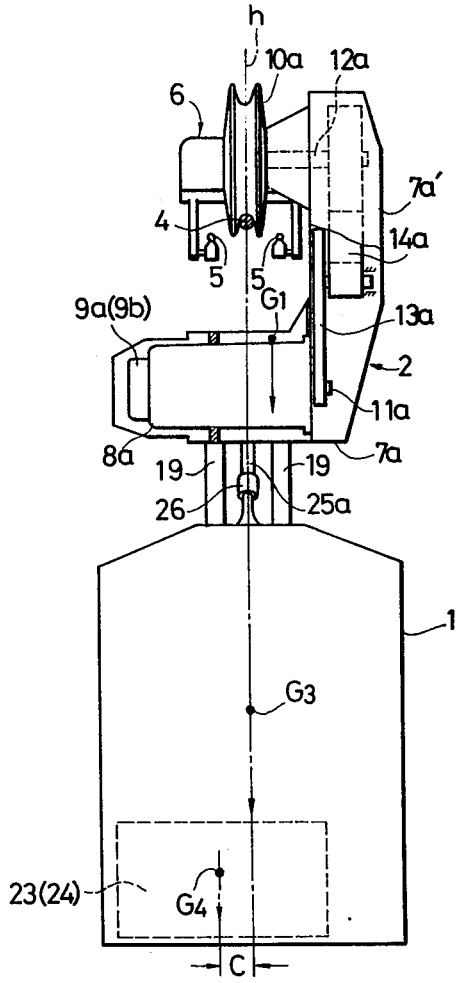
FIG. 2 is a front elevational view of the vehicle shown in FIG. 1.
Figure 3:
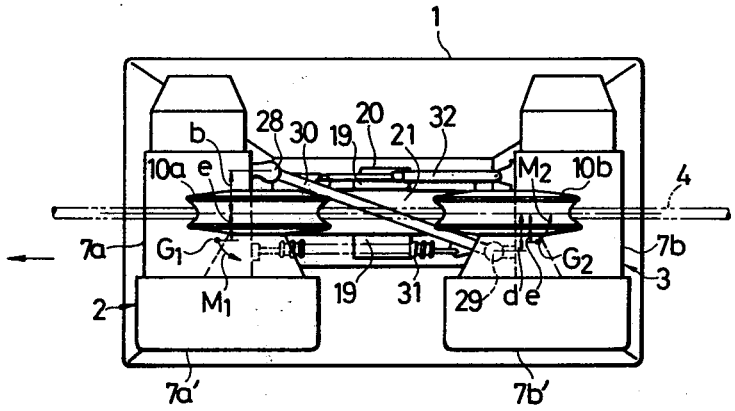
FIG. 3 is a top elevational view of the vehicle shown in FIG. 1.

Referring to FIGS. 1 to 3, 1 designates a vehicle body, 2 and 3 front and rear traction units, respectively, 4 a trackway in the form of a rope, 5 two collector cables (see FIG. 2) suspended from the rope 5 in a conventional manner and 6 a current collector.

Each of the traction units 2 and 3 has a frame 7*a* or 7*b*, a traction motor 8*a* or 8*b*, a brake 9*a* or 9*b*, a supporting wheel 10*a* or 10*b*, an output shaft 11*a* or 11*b* of the corresponding motor 8*a* or 8*b*, a wheel shaft 12*a* or 12*b* of the supporting wheel 10*a* or 10*b*, timing belts 13*a* and 14*a* or 13*b* and 14*b*, and a plurality of gears 15*a*, 16*a*, 17*a*, and 18*a* or 15*b*, 16*b*, 17*b* and 18*b*.

For mounting the traction units 2 and 3 on the vehicle body 1, a bracket 19 rigidly secured to the vehicle body has a pin 20 by which a beam 21 is rotatably mounted on the bracket 19. The beam 21 has a forward section carrying a front swivel pin 22*a* and a rearward section carrying a rear swivel pin 22*b* with respect to a forward direction as by an arrow X in FIG. 1. The front traction unit 2 is rotatably mounted on the beam 21 for rotation about the front swivel pin 22*a*, whereas the rear traction unit 3 for rotation about the rear swivel pin 22*b*.

An axis $k_1$ of the front swivel pin 22*a* and an axis $k_2$ of the rear swivel pin 22*b* are disposed in a vertical plane including therein a vertical line passing through the center of the rope 4 and the center of gravity of the vehicle, as denoted by $G_3$ (see FIG. 2).

The axis $k_1$ is inclined forwardly, that is, the upper end of the swivel 22*a* is disposed forwardly, with respect to the vehicle body 1, of the lower end of the swivel 22*a*, and makes an angle $\alpha_1$ with a vertical line $l_1$ passing through the wheel shaft 12*a*. The contact point $P_1$ of the supporting wheel 18*a* with the rope 4 is disposed on the axis $k_1$. However, the point $P_1$ may be disposed at a location positioned upwardly of the axis $k_1$. Denoted by $G_1$ is the center of gravity of the front traction unit 2 and the center of gravity $G_1$ is disposed at a location spaced from and on one side of the plane including therein the vertical line passing through the center of the rope 4 and the center of gravity of the vehicle $G_3$ (see FIG. 2), the location being spaced forwardly of the axis $k_1$ and nearer to a forward post portion 7*a*′ of the frame 7*a*.

The axis $k_2$ is inclined rearwardly, that is, the upper end of the swivel 22*b* is disposed rearwardly, with respect to the vehicle body 1, of the lower end of the swivel 22*b*, and makes the same angle $\alpha_2$ as the angle the axis $k_2$ makes with a vertical line $l_2$ passing through the wheel shaft 12*b*. The contact point $P_2$ of the supporting wheel 12*b* with the rope 4 is disposed on the axis $k_2$. However, in practice, the point $P_2$ may be disposed at a location spaced upwardly of the axis $k_2$. Denoted by $G_2$ is the center of gravity of the rear traction unit 3 and the center of gravity $G_2$ is disposed at a location spaced from and on the same side of the plane including therein the vertical line passing through the center of the rope 4 and the center of gravity $G_2$ of the vehicle (see FIG. 2), the location being spaced rearwardly of the axis $k_2$ and nearer to a rearward post portion 76′ of the frame 7*b*.

Mounted within the vehicle body 1 are controllers 23 and 24 for the motors 8*a* and 8*b* respectively. The center of gravity of each of the controllers 23 and 24 is disposed at a location spaced from and on the opposite side the plane including the vertical line passing through the center of the rope 4 and the center of gravity $G_3$ of the vehicle by a length C(see FIG. 2) to dispose the center of gravity $G_3$ within this plane. By so arranging the vehicle can be suspended from the rope 4 adequently.

As best seen in FIG. 1, the connecting beam 21 has arm sections 25*a* and 25*b* projecting downwardly from the beam 21 toward the vehicle body 1 and the arm section 25*a* is linked to one end of a shock absorber 26 and another arm section 25*b* to one end of another shock absorber 27. Opposite ends of the shock absorbers 26 and 27 are linked to the vehicle body 1 at two locations spaced in a longitudinal direction of the vehicle body 1 to prevent an excessive swinging movement (denoted by a) in a longitudinal direction upon acceleration or deceleration of the vehicle.

The current collector unit 6, which supplies current to both motors 8*a* and 8*b*, is linked to the traction unit 3 to be pulled thereby along the rope 4. The current collector unit 6 has a current collector in sliding contact with the collector cables 5.

As best seen in FIG. 3, a ball joint 28 is rigidly attached to the frame 7*a* of the front traction unit 2 at a location spaced from the rope 4 to the right, viewing along a forward direction of the vehicle, by a distance b, whereas another ball joint 29 to the frame 7*b* of the rear traction unit 3 at a location spaced from the cable 4 to the left by a distance d. These ball joints 28 and 29 are linked by a rod 30.

A tension spring 31 has one end anchored to the frame 7*a* of the front traction unit 2 and an opposite end anchored to the rod 30. This tension spring arrangement prevents the traction units 2 and 3 from rotating about their swivel pins 22*a* and 22*b*, which otherwise would occur when the vehicle is not in motion owing to the fact that the centers of gravity of the front and rear traction units 2 and 3 are disposed outside of the plane including the center of the rope 4 and the center of gravity $G_3$ of the vehicle, and also prevents rattling of the supporting wheels 10*a* and 10*b* during operation of the vehicle.

A shock absorber 32 has one end linked to the frame 7*b* of the rear traction unit 3 and an opposite end to the rod 30 to prevent rattling of the supporting wheels 10*a* and 10*b* during operation of the vehicle. A shock absorber may have one end attached to the connecting beam 21 and an opposite end to the rod 30, if desired.

The vehicle constructed as described above operates as follows:

When, in operation, the vehicle accelerates, the front traction unit 2 and the rear traction unit 3 tend to rotate about their respective swivel pins 22*a* and 22*b* in a counter clockwise direction (viewing in FIG. 3). A moment at the center of gravity $G_1$ is denoted by $M_1$, whereas a moment at the center of gravity $G_2$ by $M_2$. The moment $M_1$ is substantially equal in its quantity to moment $M_2$. These rotational movements occur because the center of gravity $G_1$ of the front traction unit 2 is spaced to the left from the rope 4 (as viewing along the rope 4 forwardly) by e (viewing FIG. 3) and forwardly from the axis $k_1$ by f, whereas the center of gravity $G_2$ of the rear traction unit 3 is spaced to the left from the rope 4 by e and rearwardly from the axis $k_2$ by f (viewing FIG. 1). These moments, however, are offset by the cross rod 30 thus preventing the tendency of the traction units 2 and 3 to rotate about their swivel pins $k_1$ and $k_2$.

When the vehicle decelerates, the moments equal in quantity to each other but in a clockwise direction (viewing in FIG. 3) will occur. These moments are balanced by the cross rod 30.

In practice, the width of grooves of the supporting wheels 10*a* and 10*b* are great enough to allow the traction units 2 and 3 to rotate about their swivel pins 22*a* and 22*b* by a small angle of approximately 2 degrees. As a result the moment $M_1$ and the moment $M_2$ become different as the traction units 2 and 3 rotate, but this difference is negligible.

The shock absorber 32 mounted between the cross rod 30 and the traction unit 3 serves as a semi damper to prevent rattling of the traction units 2 and 3, thus improving running stability of the vehicle. For this purpose, a compression spring 31 may interconnect the rod 30 and the traction unit 2 instead of the shock absorber.

The locations on the frames at which both ends of the rod 30 are so determined as to offset the momenta on the traction units which would occur upon acceleration or deceleration of the vehicle. Thus, if the distance of the center of gravity $G_1$ of the traction unit 2 is different from the center of gravity $G_2$ of the traction unit 3, the moments can be offset by suitably selecting the location on the frames 7*a* and 7*b* at which the ends of the rod 30 are attached.

The tension spring 31 can be eliminated if the swivel pins are arranged vertically.

In order to prevent the excessive slip of a rear supporting wheel 10*b* when the vehicle runs from a straight portion of the cable to a curve thereof or from a curve to a straight due to rod connection between the forward and rearward traction units 2 and 3, curvature of a curve of the rope 4 and the width of the groove of each supporting wheel are adequately determined.

Figure 4:
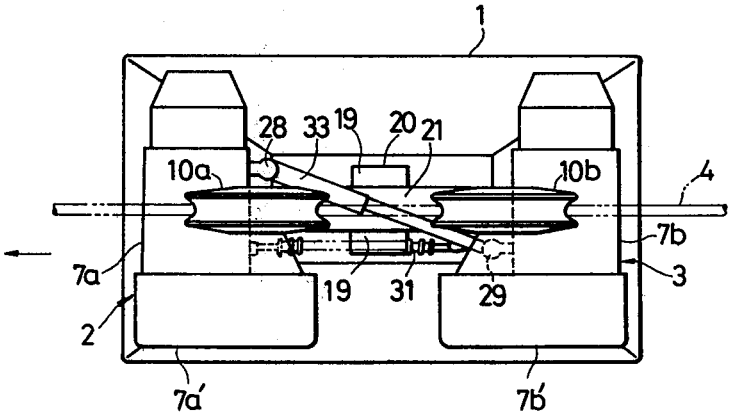
FIG. 4 is a similar view to FIG. 3 showing another embodiment of a vehicle.

Referring to the embodiment shown in FIG. 4, in which like reference numerals or characters used in the embodiment shown in FIGS. 1 to 3 are used to designate like parts, the rod 30 and the shock absorber 32 used in the preceding embodiment are replaced by a shock absorber 33 interconnecting front and rear traction units 2 and 3.

With this arrangement, the shock absorber 33 acts as a rigid rod upon acceleration or deceleration of the vehicle, but will act as a damper upon normal cruising of the vehicle.

The effects accomplished by the present invention are:

(1) Rotational movements of the traction units which would otherwise occur upon acceleration or deceleration of the vehicle are prevented because the moments $M_1$ and $M_2$ are balanced by the rod or absorber, thus improving running stability of the vehicle.

(2) The shock absorber linked between the traction units serves both as a rod and a damper.

What is claimed is:

1. In combination with a trackway of an aerial trackway system, a vehicle comprising:

a depending vehicle body;

a first traction unit having structure supporting said vehicle body and having a drive unit having a driven traction supporting wheel rotatably mounted thereon, said supporting wheel of said first traction unit being disposed on said trackway;

a second traction unit having structure supporting said vehicle body and having a second drive unit having a driven traction supporting second wheel rotatably mounted thereon, said second supporting wheel of said second traction unit being disposed on said trackway;

said first traction unit supporting said vehicle body at a front location and being rotatable about a substantially vertical axis relative to said vehicle body such that said supporting wheel of said first traction unit may follow said trackway;

said second traction unit supporting said vehicle body at a rear location and being rotatable about a second substantially vertical axis relative to said vehicle body such that said second supporting wheel of said second traction unit may follow said trackway; and a single link extending between said first and second traction units so that rotation of said first and second traction units in the same rotational direction about said first and second substantially vertical axes respectively, due to the movement of said vehicle along said trackway, is restricted so that rotation of one of the traction units in a first rotational direction about its respective axis causes the other traction unit to rotate in the second opposite direction.

2. A vehicle as claimed in claim 1, in which said linking means includes a cross rod having one end linked to said first traction unit and an opposite end linked to said second traction unit.

3. A vehicle as claimed in claim 2, further comprising a tension spring having one end anchored to said cross rod and an opposite end anchored to said first traction unit, and a shock absorber having one end linked to said second traction unit and an opposite end linked to said rod.

4. A vehicle as claimed in claim 1, in which said linking means includes a shock absorber having one end linked to said first traction unit and an opposite end linked to said second traction unit.

5. A vehicle as claimed in claim 4, further comprising a tension spring having one end anchored to said shock absorber and an opposite end anchored to said first traction unit, and a second shock absorber having one end linked to said second traction unit and an opposite end linked to said first mentioned shock absorber.

6. In a vehicle for an aerial trackway, a first traction unit having structure supporting said vehicle and having a drive unit having a driven traction supporting wheel rotatably mounted thereon, said wheel being rollably received on said trackway, said first traction unit being pivotal about a substantially vertical axis which lies on a plane including said supporting wheel and the center of gravity of said vehicle and the center of said trackway, said first traction unit having a center of gravity spaced to one side of said plane;

a second traction unit having structure supporting said vehicle and having a second drive unit having a driven traction supporting second wheel rotatably mounted thereon, said second wheel being rollably received on said trackway, said second traction unit being pivotal about an axis which lies on said plane, the last inventioned supporting wheels being disposed in said plane, said second traction unit having a center of gravity spaced to said one side of said plane; and a single link having a first end pivotally connected to said first traction unit at a point located to one side of said plane and a second end pivotally connected to said second traction unit at a point located to the opposite side of said plane so that said link extends between said first and second traction units and intersects said plane.

7. A vehicle as set forth in claim 6, wherein said link is a shock absorber.

8. A vehicle as set forth in claim 6, wherein said link is a rod.

9. A vehicle as set forth in claim 6 further comprising biasing means interconnecting said first and second traction units, said biasing means extending substantially parallel to said plane.

10. A vehicle as set forth in claim 9, wherein said biasing means comprises a tension spring.

* * * * *